US007347703B2

(12) United States Patent
Gallardo

(10) Patent No.: US 7,347,703 B2
(45) Date of Patent: Mar. 25, 2008

(54) SAFETY DEVICE TO MAKE ELECTRICAL PLUGS DIFFICULT TO REMOVE FROM ELECTRICAL OUTLETS

(76) Inventor: Eugenio Gallardo, P.O. Box 720625, Miami, FL (US) 33172

( * ) Notice: Subject to any disclaimer, the term of this patent is extended or adjusted under 35 U.S.C. 154(b) by 0 days.

(21) Appl. No.: 11/784,466

(22) Filed: Apr. 7, 2007

(65) Prior Publication Data

US 2007/0243750 A1 Oct. 18, 2007

Related U.S. Application Data

(60) Provisional application No. 60/792,839, filed on Apr. 18, 2006.

(51) Int. Cl.
*H01R 13/44* (2006.01)

(52) U.S. Cl. ..... 439/144; 439/133; 439/346; 439/373

(58) Field of Classification Search ..... 439/133–137, 439/144–146, 346, 373
See application file for complete search history.

(56) References Cited

U.S. PATENT DOCUMENTS

| | | | | |
|---|---|---|---|---|
| 4,012,098 | A * | 3/1977 | Tolnar, Jr. | 439/346 |
| 4,530,556 | A * | 7/1985 | Bonus | 439/296 |
| 5,813,873 | A * | 9/1998 | McBain et al. | 439/145 |
| 6,159,034 | A * | 12/2000 | Royer | 439/373 |
| 7,077,683 | B1 * | 7/2006 | Ross | 439/346 |

* cited by examiner

*Primary Examiner*—Truc Nguyen

(57) ABSTRACT

A safety device created to make the electrical plugs difficult to remove from the electrical outlets, wherein is made with a non conductor material and it has a flat and thin main body, which has notches that allow the connectors of the plug to go across the device and with a fitter fin which is united and perpendicular to the main body, with a general rectangular shape, wherein this main body is used leaning it against the flat part of the plug, from which the blades of the plug start, previously to the connection of the plug to the electrical outlet, remaining the fitter fin resting along and preferably above one of the blades of the plug, preferably the wider connector, artificially enlarging in this way its width, diminishing therefore the space that exist between that connector of the plug and the hole of the electrical outlet.

7 Claims, 5 Drawing Sheets

SAFETY DEVICE TO MAKE ELECTRICAL PLUGS DIFFICULT TO REMOVE FROM ELECTRICAL OUTLETS

CROSS-REFERENCE TO RELATED APPLICATIONS

This application claims the benefit of Provisional Application No. U.S. 60/792,839 filed on Apr. 18, 2006, entitled: "Child safety device to make electrical plugs difficult to remove", by applicant: Eugenio Gallardo residing at Miami, Fla. is claimed under 35 U.S.C. section 119(e).

FIELD OF THE INVENTION

This invention consists in a safety device, created with the purpose to make difficult the disconnection of an electrical plug from the electrical outlet, device which is used in combination with the electrical plug and the electrical outlet.

BACKGROUND OF THE INVENTION

Accidental removals of electrical plugs from wall outlets, commonly take place for different motives and commonly when somebody use electrical equipments like a vacuum cleaner and other mobiles equipments, but in some cases, all kind of electrical equipments (not just the mobile equipments) can be accidentally unplugged when the equipments are still in use and this can occur due toddlers who can feel themselves tempted to disconnect the electrical plugs from the electrical outlets, with the consequent danger to receive electrical shocks if the plug is still alive with electricity.

Different safety devices as been developed to block the access to the holes of electrical outlets when it is not in use. These systems, in general, avoid the possibility to introduce elements on those holes or that the toddlers introduce their fingers in it, avoiding in this way accidental electrical shocks. These devices can achieve this objective, using elements that cover the electrical outlet or using non conductor elements that can be inserted in its holes.

Also, a wide variety of devices have been developed in order to resolve the initial mentioned problem to avoid accidental removal of electrical plugs that are connected to electrical outlets, but many of these devices are relatively complex and therefore, relatively expensive and difficult or delicate in its handling. These characteristics have made difficult their massive implementation in order to be used with the different electrical equipments that everybody uses daily.

In the patent U.S. Pat. No. 4,867,697 by Albert BORGES with title "Self-locking, two-part electrical connector employing receptacle with spring-biased wedge for expanding plug's blades", is described an electrical self-secure connector which includes an electrical plug and its electrical outlet, with a mechanism that uses a spring which automatically secure the plug against the outlet when they both are connected.

The safety device for electrical connectors of the patent U.S. Pat. No. 6,171,129 by Phillips DUANE A, with title "Locking electrical adapter", provides an electrical adapter with a plug-terminal in one end and an outlet-terminal in the other end, with two independent mechanisms of security which use springs elements. The secure mechanism used here are similar to the mechanism mentioned in Patent U.S. Pat. No. 2,261,615 by Leroy CORNWELL, with title "Electrical connector".

In the patent U.S. Pat. No. 2,436,586 by MANGOLD ELI F, with title "Socket plug for electrical outlets" is showed a security system, which avoids the disconnection of the plug from the electrical wall outlet, using two adjacent bars which fix the plug to the outlet.

The patent U.S. Pat. No. 6,050,837, by DUHE JR JERRY R., with title "Electrical locking plug" describes another electrical connector with other particulars characteristics.

The majority of these security devices have special characteristics which imply to manufacture the plugs and/or outlets with those special characteristics, wherein the device can't be used in electrical plugs and/or electrical outlets that doesn't incorporate that particular security characteristics, however the present invention provide a security device that can be used in a standard plugs, in order to make difficult its disconnection when it is connected in a standard outlet.

BRIEF SUMMARY OF THE INVENTION

The invention consists in a safety device, created in order to make difficult the disconnection of an electrical plug connected to an electrical outlet, device which is used in combination with the plug and the electrical outlet.

The device includes a main body like a plate, which need to be installed against the flat surface of an electrical plug (from which the connectors or blades start), and wherein some parts of this main body are arranged between these connectors. The device also have an small fitter fin, that is perpendicular and united to the main body, which at the time of the use it leans above or below one of the connectors of the electrical plug, (preferentially over the bigger connector), and the purpose of this fitter fin is to diminish the space that exist between the plug and the electrical outlet, when the electrical plug is connected in the electrical outlet, increasing in this way the difficulty to disconnect the electrical plug from the electrical outlet.

The fitter fin, perpendicular to the main body, can have different longs and can be straight and/or undulated and its upper part can be smooth and/or rough and/or serrated and/or undulated and its end can be straight and/or semicircular and/or with a wedge shape.

When the device is used in combination with the plug and the outlet, the device can still achieve its objective of make the plugs difficult to remove from the electrical outlet, as long as the fitter fin has a proper long and width.

The long and shape of the fitter fin will make the disconnection of the plugs from the electrical outlets more o less difficult. If the fitter fin is longer and serrated, the disconnection of the plug from the electrical outlet could be more difficult than if the fitter fin is shorter and smooth, In some cases, depending on the design used in the fitter fin, the only way to disconnect the electrical plug from the electrical outlet is pulling out from the outlet the device and the electrical plug both together at the same time.

This device is made with a nonconductor material and in its different designs it is considered that the fitter fin can be straight or undulated with its upper side smooth, rough, undulated or serrated, and its end can be straight, semicircular o with a wedge shape, all of this in order to decrease or increase the difficulty of disconnection of the electrical plug from the electrical outlet, wherein the section of the main body that is arranged between the connectors or blades of the electrical plug, can have a bigger or smaller length, depending if it requires to be used with an electrical plug which have two or three connectors respectively.

BRIEF DESCRIPTION OF THE DRAWINGS

The following figures show different designs of the invention in order to understand in a better way its characteristics and functionalities.

The FIG. 1—Shows the device in one of its designs, in use with a plug with two connectors or blades.

Figure 2:
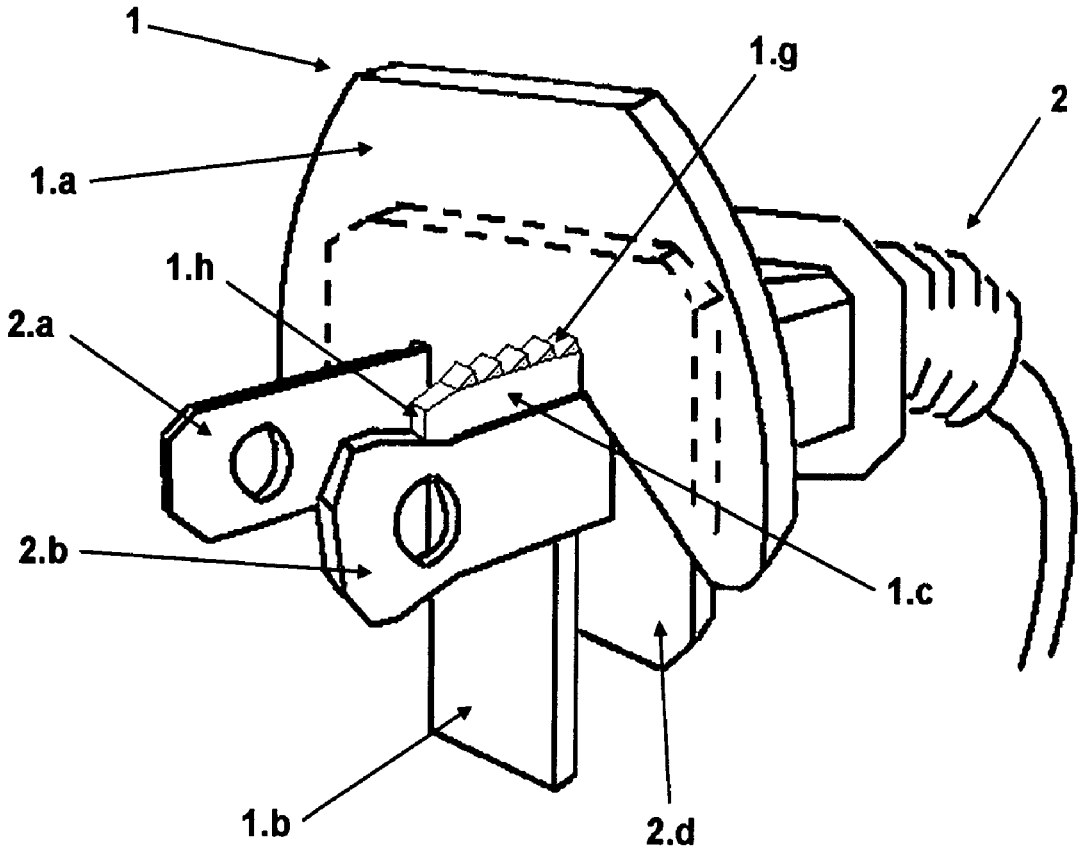
Figure 3:
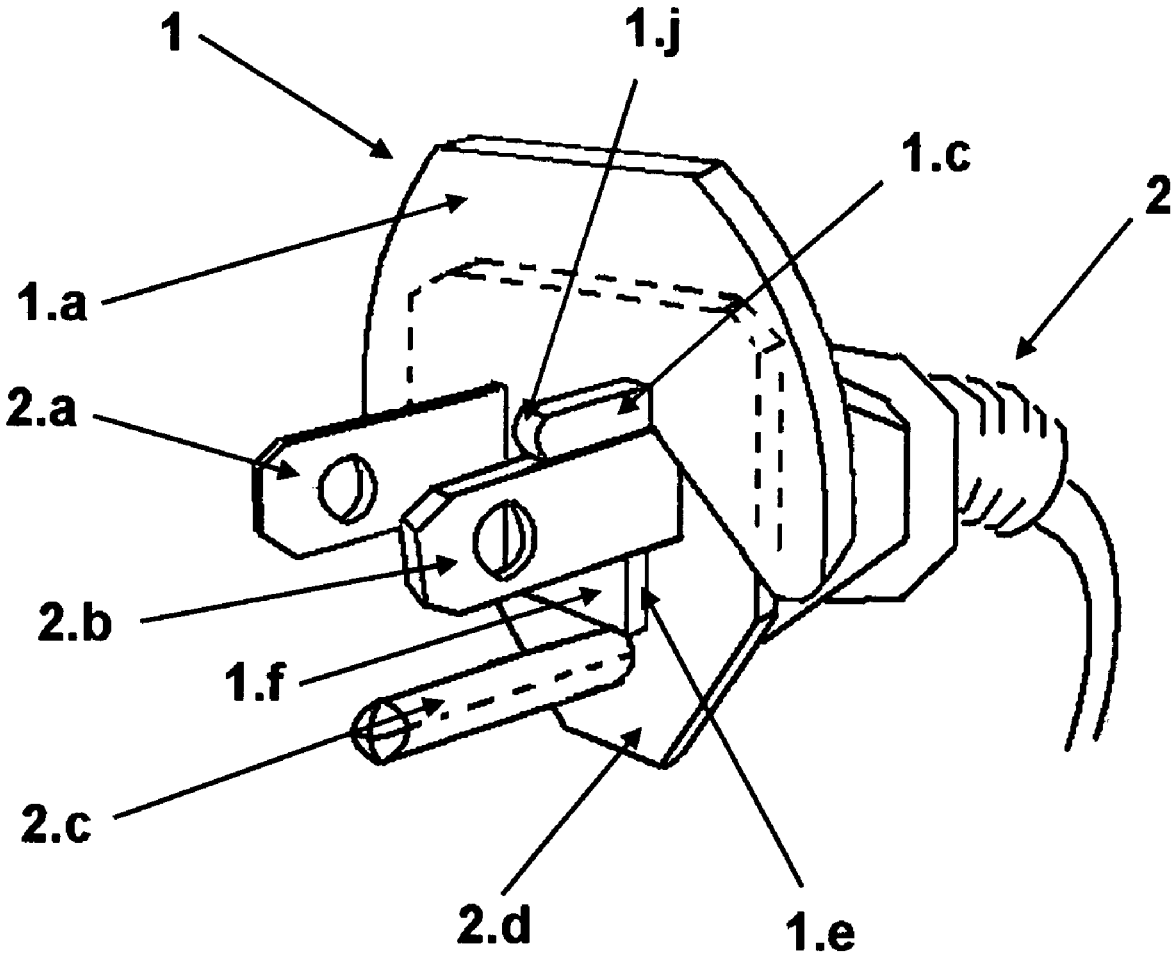

The FIG. 2—Shows the device in other of its designs, wherein the fitter fin is serrated The FIG. 3—Shows the device in other of its designs, in use with a plug with three connectors or blades.

Figure 4:
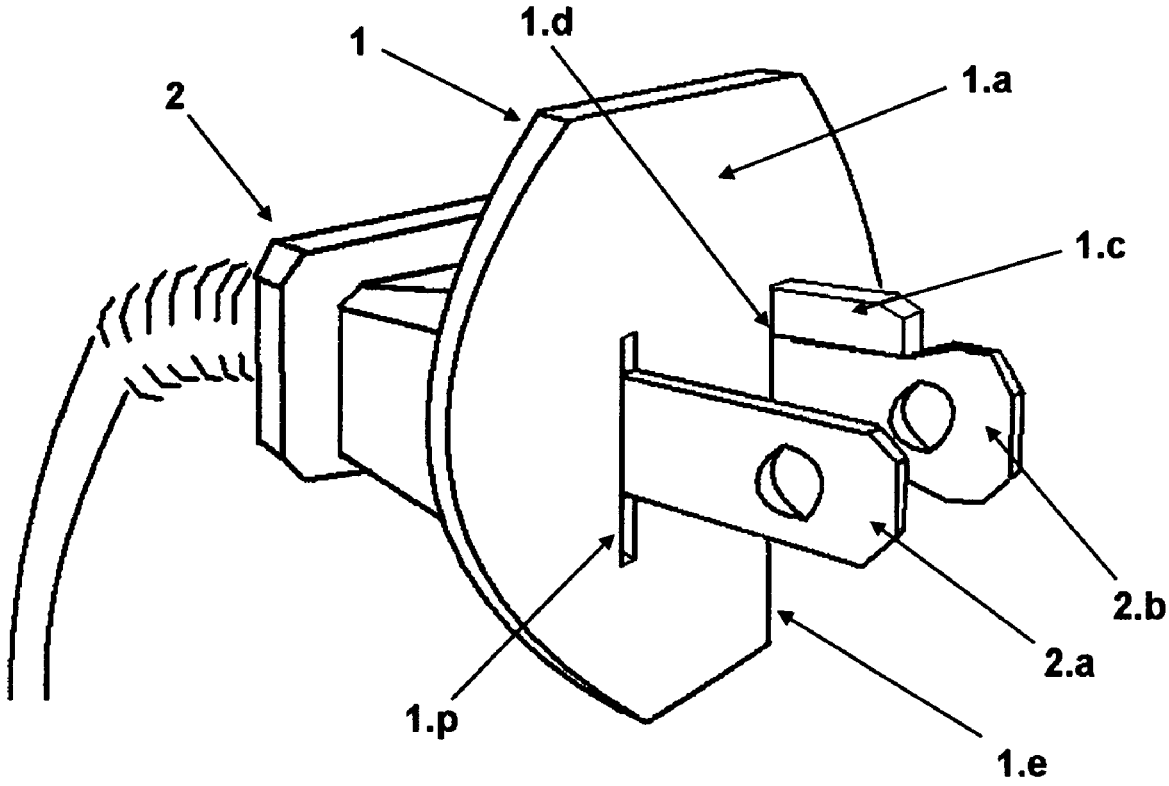
Figure 5:
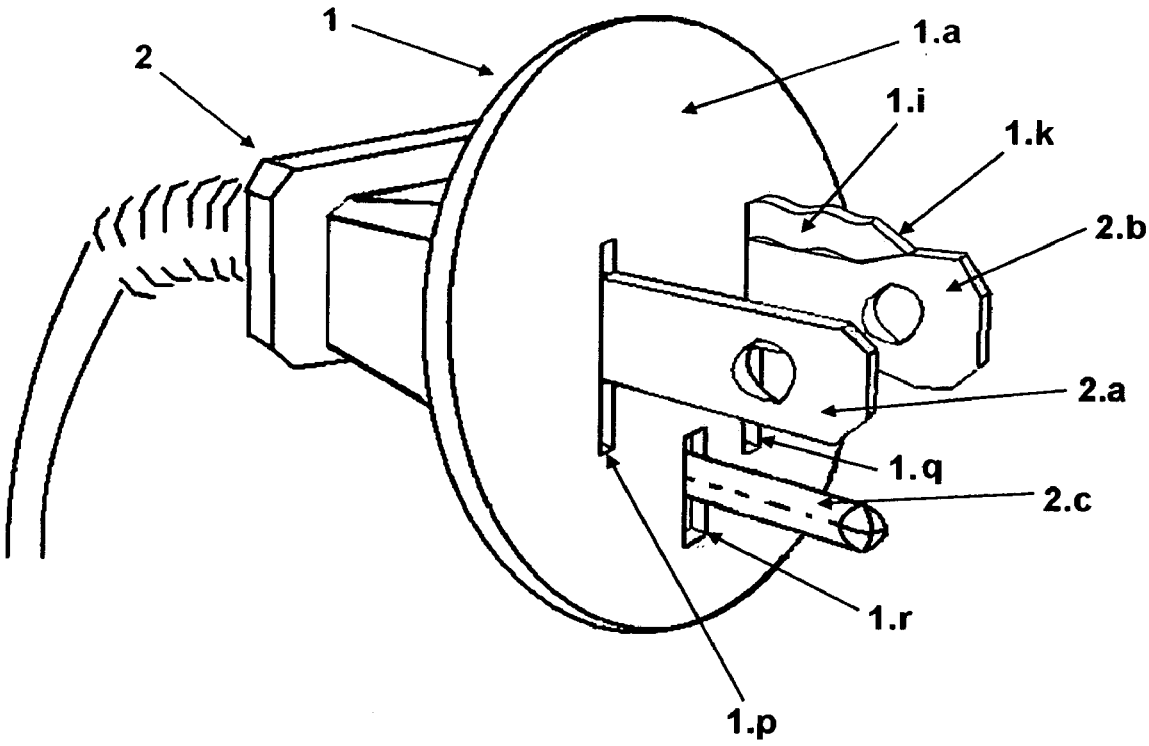

The FIG. 4—Shows the device in other of its designs, with a semi circular shape The FIG. 5—Shows the device in other of its designs, with a circular shape and the fitter fin undulated and ending in a wedge shape.

DETAILED DESCRIPTION OF THE INVENTION

The invention consist in a safety device (1) which can reduce the risk of electrical shock due the inappropriate manipulation of electrical plugs when the toddlers try to remove it from the electrical outlets and/or to protect electrical equipments from an involuntary disconnection when they are in use.

The invention is an independent device from the electrical plug and the electrical outlet, device that is installed preferably in the electrical plug which is going to be connected to the outlet. The device can be used in standard plugs from different electrical equipments.

The structure of the device is formed by two parts: One main body (1.*a*) and the fitter fin (1.*c*, 1.*i*), which is perpendicular and united to the main body.

The main body (1.*a*) of this safety device is flat, thin and preferably rigid, which have sectors that allow the connectors or blades of the plug (2.*a*, 2.*b*, 2.*c*) to go across the device.

The main body (1.*a*) can have different designs:

a) Wherein the main body (1.*a*) shows its upper part with a shape that is preferably semicircular (FIGS. 1, 2 and 3) and from which its central part shows a lower extension (1.*b*) with a preferably rectangular shape and in the same plane of its upper part. The width of this lower extension is less but similar to the width that exist between the two connectors or blades of the electrical plug (2.*a*, 2.*b*) in order to put this part of the device between these connectors. In this design the fitter fin (1.*c*) is perpendicular and united in one of the vertex (1.*d*) of the rectangular lower extension (1.*b*).

b) Wherein the main body (1.*a*) has a preferably semi circular shape (FIG. 4) which has a slot (1.*p*) which allows one of the connectors of the plug (preferably the thinner) to go across the device. In this design the main body shows a notch (1.*e*) with a flat edge parallel to the slot and it extends from around the middle part of the main body to its lower part and wherein the distance between this flat edge and the slot is similar to the distance that exist between the two blades of the plug, allowing to put this part of the main body of the device between the blades of the plug. The fitter fin (1.*c*) in this configuration, is located in a perpendicular way in the vertex (1.*d*) of the notch previously described c) Wherein the main body (1.*a*) has a preferably circular shape (FIG. 5) which has two (1.*p*, 1.*q*) or three slots (1.*p*, 1.*q*, 1.*r*), which allows the connectors of the plug with two (2.*a*, 2.*b*) or three connectors (2.*a*, 2.*b*, 2.*c*) respectively, to go across the device. In the design with three slots, the main body shows two parallels and rectangular slots located around the middle part of the main body (1.*p*, 1.*q*) and a third rectangular slot located in the middle and below them (1.*r*). The first two slots extends vertically with a distance between them similar to the distance that exist between the two electrical connectors or blades (2.*a*, 2.*b*) of an electrical plug, in order to allow these connector to go across the device. The third slot (1.*r*) extends vertically but in the inferior part of the main body, in a distance from the other slots similar to the distance that exist between the ground connector of the plug (2.*c*) and the other two electrical connectors of the plug (2.*a*, 2.*b*), in order to allow the ground connector of the plug to go across the device. The fitter fin (1.*i*) in this configuration, is located in a perpendicular way above or below one of the first two slots, preferably where the bigger connector of the plug (2.*b*) is going to be inserted (1.*q*).

This security device (1) manufactured in a non-conductor material, is used leaning the main body (1.*a*) of the device against the flat part of the plug (2.*d*) (from which the blades of the plug start) previously to the connection of the plug to the electrical outlet, remaining the fitter fin (1.*c*, 1.*i*) resting along and above (or below, depending on the design) one of the blades of the plug, preferably the bigger blade (2.*b*).

Due the design and the size of the different parts of the device (1), when it is installed in the plug (2), the device remains attached to the plug and doesn't loose easily, remaining joined as a single element, but at the same time they can be separated without difficulty.

When the devise is used with an electrical plug which is connected to an electrical outlet, the fitter fin (1.*c*, 1.*i*), because is resting above (or below) one of the connector of the plug (preferably the bigger connector), artificially enlarge the width of that connector, diminishing in that way the space that exist between that connector of the plug and the hole of the electrical outlet, increasing in this way the difficulty to disconnect the plug from the electrical outlet.

In some cases, when an electrical plug is connected to the electrical outlet in combination with this invention, the only way to disconnect the electrical plug from the electrical outlet is pushing out the device and the electrical plug both together at the same time. This can occur depending on the design used in the fitter fin and because it is resting above (or below) the bigger connector (2.*b*). In some cases, if the invention and the plug are not removed from the outlet together at the same time and just the plug is pulled out, the wider part of the bigger connector and the fitter fin can add its widths inside the electrical outlet and if that occur, the electrical plug (2) can't be removed, because the size of the hole in the electrical outlet wherein they are connected is not big enough.

The long of the lower extension (1.*b*) of the main body in this device (1) can have different longs, depending if the invention is going to be used with plugs with two (2.*a*, 2.*b*) or three connectors (2.*a*, 2.*b*, 2.*c*). A longer extension of this part allows to block the "ground" hole of the electrical outlet.

To any configuration of the present invention, the fitter fin can be straight (1.*c*), undulated (1.*i*) or a combination of these shapes, with the purpose of increase or decrease the difficulty to disconnect the plug (2) from the electrical outlet.

To any configuration of the present invention, the upper part of the fitter fin can be serrated (1.*g*), undulated, rough, smooth, or a combination of these shapes with the purpose of increase or decrease the difficulty to disconnect the plug (2) from the electrical outlet.

To any configuration of the present invention, the end of the fitter fin can be straight (1.*h*), semicircular (1*j*), like a wedge (1.*k*) or a combination of these shapes with the purpose of increase or decrease the difficulty to disconnect the plug (2) from the electrical outlet.

When the fitter fin is serrated, due the orientation of the teeth (1.*g*), the disconnection of the plug from a wall outlet, in combination with the device (1), is more difficult because some of these teeth can get snagged inside the case of the wall outlet, but always allowing the future disconnection of the plug from the outlet.

Depending on the design of the fitter fin, the difficulty to disconnect the plug from the electrical outlet can be more or less complicated, wherein in some cases the only way to do it is removing from the outlet both devices (the plug and the invention) together at the same time.

Depending on the design and size of the fitter fin, the difficulty to connect the plug in the electrical outlet can be relatively complicated, wherein in some cases the only way to do it is when the end of the fitter fin has a wedge shape.

The size of this device (1) is similar to the size of an electrical plug (2), in order to be used in combination with the plug and the outlet.

The use of this device (1) in combination with the plug and the outlet, make more difficult the connection and/or disconnection of the plug (2) in/from the electrical outlet, diminishing in this way the possibility that toddlers receive electrical shock when they try to connect or disconnect electrical plugs in/from the outlets.

The use of this device also diminish the possibility that electrical appliance can be disconnected accidentally.

Also, if the invention (1) is used in combination with the plug (2) and the outlet and assuming that the plug is not properly connected in the electrical outlet, remaining not completely inserted, the main body of the device avoids an easy access to the blades of the plug, avoiding potential electrical accidents mainly to the toddlers.

Figure 1:
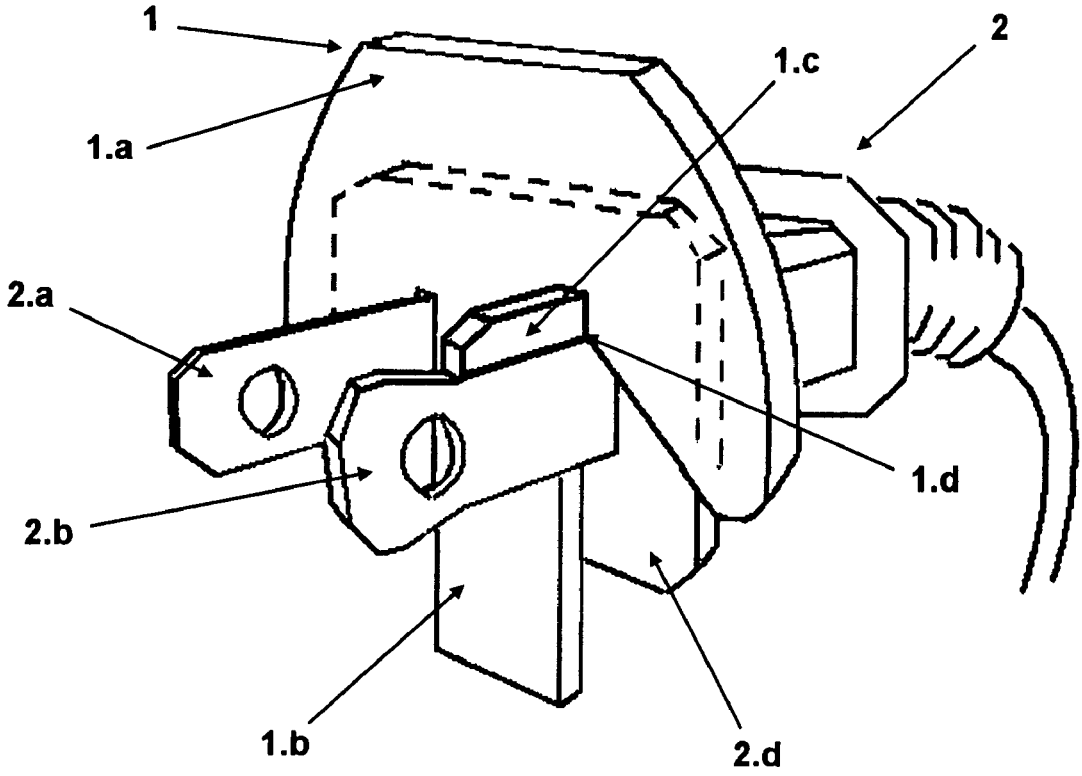

The FIG. 1 shows a general view of the device, showing a first design of the invention (1) in use with a plug (2) with two connectors or blades (2.*a*, 2.*b*), wherein we identify the main body (1.*a*) of the device (1) installed against the flat surface of the plug (2.*d*) from which the connectors (2.*a*, 2.*b*) of the plug (2) start. Also the figure shows the lower extension (1.*b*) of this device (1) located between the connectors (2.*a*, 2.*b*) which it leans against the flat surface of the plug (2.*d*). Also the figure shows the fitter fin (1.*c*) united and perpendicular to the main body of the invention (1.*a*) and remaining above one of the connectors, preferably the bigger connector (2.*b*). In this design the fitter fin is straight with its upper part smooth and the lower extension (1.*b*) goes lower than the inferior part of the plug, covering in that way the ground hole of the electrical outlet when the device is used in combination with the plug and are connected in the electrical outlet.

The FIG. 2 also shows another design of the invention in a general view of the device, with the same configuration of the FIG. 1, wherein the fitter fin (1.*c*) is straight but with its upper part serrated (1.*g*) and its end is straight (1.*h*).

The FIG. 3 show a third design of the invention (1), wherein the lower extension (1.*f*) of the main body (1.*a*) is shorter than the past figures, because it can be used with plugs with three connectors (2.*a*, 2.*b* and 2.*c*) and wherein the fitter fin (1.*c*) ends in a semicircular shape (1.*j*).

The FIG. 4 shows a fourth design of this invention (1), with a semi circular shape of the main body (1.*a*), which has a slot (1.*p*) from which can be inserted one of the connectors of the plug (preferably the thinner connector) (2.*a*), and the other connector of the plug (preferably the bigger connector) (2.*b*) is installed in the notch (1.*e*) that the main body of the device (1.*a*) has in one of its sides. In this configuration the fitter fin is located perpendicular to the main body in one of the upper vertex of the notch (1.*d*)

The FIG. 5 shows a fifth design of this invention (1), wherein the main body (1.*a*) has a preferably circular shape which can have two slots (1.*p*, 1.*q*) or three slots (1.*p*, 1.*q*, 1.*r*), which allows the blades of the plug with two connectors (2.*a*, 2.*b*) or three connectors respectively (2.*a*, 2.*b* and 2.*c*), to go across the device and wherein the fitter fin (1.*i*) is undulated and little longer than the previous figures, ending in a wedge shape (1.*k*).

The invention claimed is:

1. An electrical safety device created to make an electrical plug difficult to remove from a plurality of insertion holes of an electrical outlet, the device comprising:

an electrical insulating material flat thin main body, the main body has a plurality of slots that allow a plurality of blades of the plug insert there through;

an electrical insulating material fitter fin integral with the main body having a general rectangular shape, the fitter fin is positioned perpendicular to the main body;

wherein the main body is leaning it against a flat surface of the plug, the blades of the plug extending from the flat surface;

wherein each of the blade having an elongated body and a width;

wherein the insertion holes having a polarity configuration;

wherein a space is formed between the elongated body and the wider insertion hole when the plug is inserted into the electrical outlet;

wherein the fitter fin is resting along above or below a side edge of one of the elongated body of the blade, prior to the plug insert into the electrical outlet;

wherein the fitter fin is artificially enlarging the width of the elongated body, thus diminishing the space when the electrical plug inserted into the electrical outlet.

2. The electrical safety device according to the claim 1, wherein the main body has a preferably circular shape with three elongated slots, two of them parallel between them and located around the middle part of the main body and the third slot located between and below the other two slots, wherein these three slots allow a three-connectors plug to go across the device and wherein the fitter fin is located above or below one of the parallel slots, preferably where the bigger connector is going to be installed.

3. The electrical safety device according to the claim 1, wherein the fitter fin is undulated.

4. The electrical safety device according to the claim 1, wherein upper edge of the fitter fin is undulated.

5. The electrical safety device according to the claim 1, wherein a distal end of the fitter fin has a wedge shape.

6. The electrical safety device according to the claim 1, wherein the only way to disconnect the electrical plug from the electrical outlet, when the device is used in combination with the plug and the outlet, is pulling out the device and the electrical plug both together at the same time.

7. The electrical safety device according to the claim 1, wherein the safety device remains attached to the plug and does not loose easily when the device is installed in the plug.

* * * * *